US005695348A

United States Patent [19]

Legrady

[11] Patent Number: 5,695,348

[45] Date of Patent: Dec. 9, 1997

[54] SURFACE MOUNT ELECTRICAL CONTACTS

[75] Inventor: Janos Legrady, Putnam Valley, N.Y.

[73] Assignee: Zierick Manufacturing Corporation, Mt. Kisco, N.Y.

[21] Appl. No.: 395,618

[22] Filed: Feb. 28, 1995

Related U.S. Application Data

[63] Continuation-in-part of Ser. No. 121,206, Sep. 14, 1993, abandoned.

[51] Int. Cl.[6] ..... H01R 9/09

[52] U.S. Cl. ..... 439/78; 439/885; 439/940

[58] Field of Search ..... 439/78, 83, 507, 439/874–876, 884, 885, 940

[56] References Cited

U.S. PATENT DOCUMENTS

| | | | |
|---|---|---|---|
| 3,375,486 | 3/1968 | Clayton . | |
| 3,428,934 | 2/1969 | Reider, Jr. et al. . | |
| 3,663,931 | 5/1972 | Brown | 439/75 |
| 3,864,014 | 2/1975 | Lynch | 439/389 |
| 4,017,142 | 4/1977 | Clark et al. | 439/820 |
| 4,369,572 | 1/1983 | Atkins | 439/885 |
| 4,395,087 | 7/1983 | Gorre et al. | 439/884 |
| 4,907,991 | 3/1990 | Kobayashi | 439/876 |
| 5,073,132 | 12/1991 | Nottrott | 439/884 |
| 5,152,056 | 10/1992 | Shook | 439/876 X |
| 5,490,788 | 2/1996 | Mazzochette | 439/876 X |

*Primary Examiner*—Khiem Nguyen
*Attorney, Agent, or Firm*—Lackenback Siegel Marzullo Aronson & Greenspan, P.C.

[57] ABSTRACT

A surface mounted contact for surface mounting on a generally flat conductive surface of a printed circuit board includes a base which has a generally flat surface suitable for contact with an attachment to a conductive surface of the printed circuit board. An electrical contact, which may be in the form of a pin, post, IDC, test point, receptacle, or jumper has at least one portion projecting from the base in a direction normal to the base. At least one bent intermediate connecting portion integrally connects the contact to the base. The contact, base and the bent intermediate connecting portions are all formed from a generally flat sheet of conductive material. A blank for the surface mounted connector, as well as a rolled strip of connectors is disclosed.

9 Claims, 12 Drawing Sheets

FIG. 17
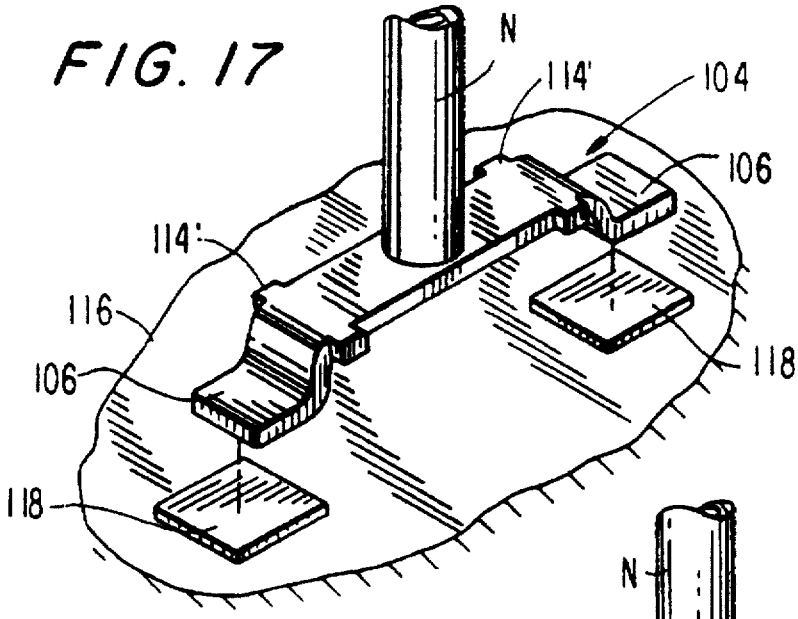
FIG. 7A
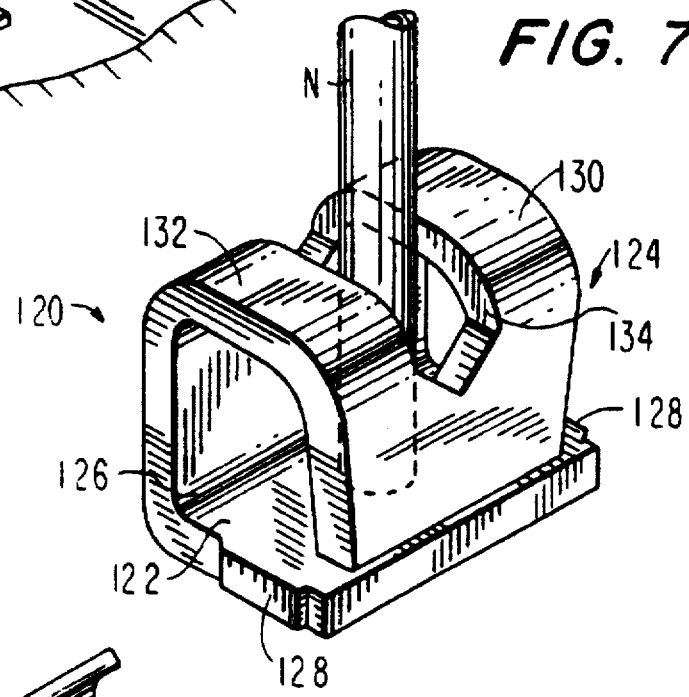
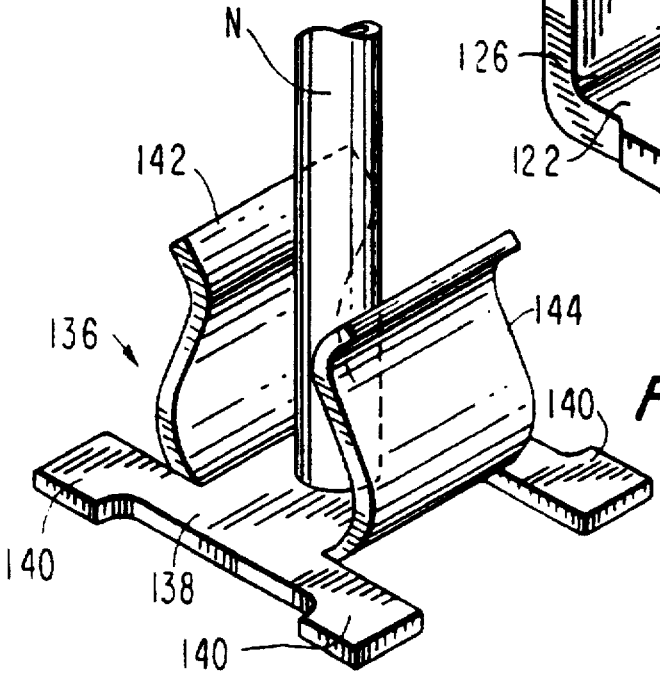
FIG. 15B

FIG. 15
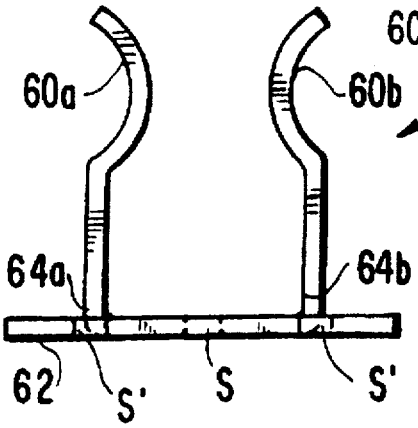
FIG. 15A
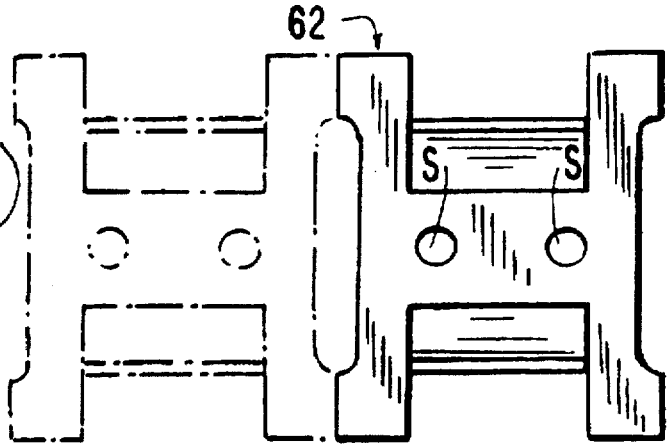
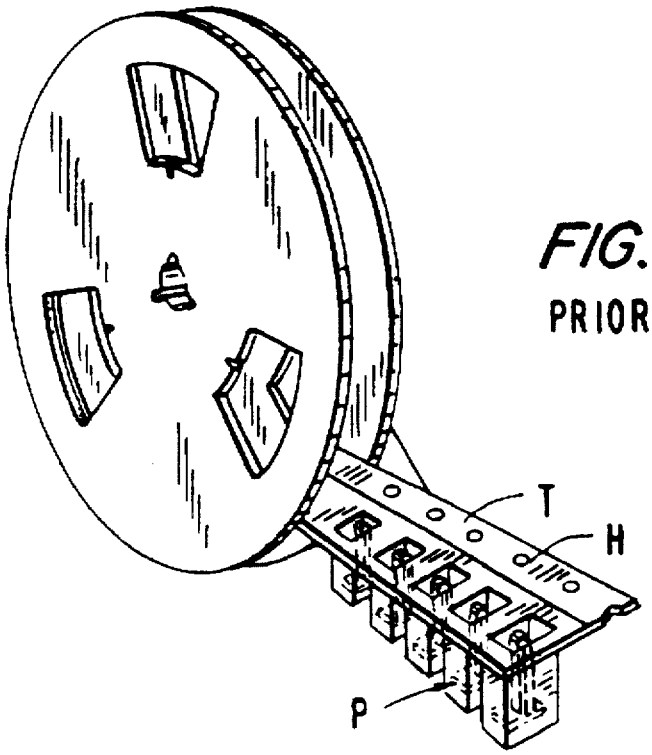
FIG. 18
PRIOR ART

SURFACE MOUNT ELECTRICAL CONTACTS

CROSS REFERENCE TO RELATED APPLICATION

This application is a Continuation-In-Part of U.S. patent application Ser. No. 08/121,206 filed Sep. 14, 1993 now abandoned.

BACKGROUND OF THE INVENTION

The invention generally relates to electrical contacts, and more specifically, to surface mounted electrical contacts that can be mounted on the surfaces of printed circuit boards by automated surface component mounting equipment, capable of sequentially picking up the electrical contacts, one at a time, and transferring them from a pick-up station to a mounting station for accurately mounting on a printed circuit board.

Numerous electrical contact designs have been proposed for mounting on printed circuit boards. Many of these are for pins or posts that are formed by stamping flat sheet stock. In many cases, the pins or posts are initially connected to each other by a carrier strip to allow automated mounting on a printed circuit board. The aforementioned pins or posts take on different shapes, including relatively flat shapes as shown in U.S. Pat. No. 5,073,132. Thin flat posts are shown in U.S. Pat. No. 3,864,014. Box-type male connectors are illustrated in U.S. Pat. No. 3,375,486. Relatively large cross-section pins are also disclosed in U.S. Pat. Nos. 4,017,142 and 3,428,934.

In U.S. Pat. Nos. 4,395,087 and 3,663,931, substantially square, solid pins are utilized for the electrical contacts. In the '087 patent, the pins are mounted on a carrier strip while in the '931 patent a unitary pin is shown formed integrally with a socket contact, presumably formed out of stamped material. In U.S. Pat. No. 4,369,572, a substantially solid rectangular pin is shown welded to the carrier strip. However, none of the known designs disclose pin connectors formed from flat sheet stock adapted or suitable for surface mounting on a printed circuit board.

It is also known to provide single loose surface mount pin terminals each packaged in individual plastic pockets P carried by a plastic pocket carrier or tape T, as shown in FIG. 18. However, the aforementioned approach has a number of problems and has not found wide acceptance in the industry. To begin with, the additional plastic pockets or envelopes P have increased the per unit costs of the surface mounted components. Additionally, because the surface mounted pins are contained within a normally oversized pocket or enclosure, the components have at least some degree of freedom of movement therein and this has made it difficult and impractical to precisely align the components at the pick-up stations of the automatic pick-and-place equipment with the vacuum nozzles used for this purpose, notwithstanding the sprocket or pilot holes H intended to accurately align the pins. Such machinery demands very accurate alignment of the pans during pick-up and even small misalignments from the required positions may cause damage to the pans and/or to the nozzles themselves.

In view of the foregoing, although significant advancements have been made in the design and use of pick and place equipment, such machinery has primarily been used to pick and place components that have a sufficiently large flat surface to provide a suction area for engagement by the nozzles. As such, such machinery has primarily been used to pick and place transistors, ICs, capacitors, and numerous other electrical components that provide the requisite surfaces. However, because electrical posts, test points, IDC's and other electrical receptacles have not always exhibited the requisite geometries suitable for pick and place equipment, it has not always been possible to automate the mounting of such components utilizing surface mount technology.

Until now, therefore, surface mount posts were packaged in header form utilizing a plastic body to hold a row of components and placed on the board by a pick-and-place robot. If there was a need for test points, tabs, IDCs or any other type of single terminal, the board and the manufacturing process had to be a combination of surface mount technology and through-hole technology, because those terminals were only available for through-hole technology.

On electrical packaging, quite often, traces on the printed circuit board have to cross each other. While this can be easily done on a double sided PC board, by utilizing a via (plated through hole) to connect traces from one side of the board to the other side of the board. Using this method, the need to cross two conductive traces on the top side of the board is done by going underneath the board with one trace through two vias. This practice is not possible with the increasingly popular aluminum printed circuit boards or other single sided boards. In those cases, the common industry practice is to use zero ohm surface mount resistors or jumpers. Those components must be taped to lend themselves to automatic placement utilizing a vacuum component placement system.

The taping of surface mount components is a widely used industry practice. The components are placed in little buckets which are part of a continuous plastic tape and they are sealed in place with a tape over it. The continuous tape winds on a reel. The reel is placed on a tape feeder. Several tape feeders are mounted on a vacuum component placement system. The feeders will unwind, index, and peel off the top tape from the strip to expose the component to the vacuum pick-up nozzle which in turn picks up the component from the tape bucket and places it on the proper location on the surface mount circuit board. The above mentioned taping process is very expensive, quite often costing more than the component.

SUMMARY OF THE INVENTION

Accordingly, it is an object of the present invention to provide surface mount electrical connectors that do not possess the disadvantages inherent in prior art surface mount connectors.

It is another object of the present invention to provide surface mount electrical connectors that are simple in construction and economical to manufacture.

It is still another object of the present invention to provide a surface mount electrical connector that can readily be used with pick-and-place automated surface mount equipment.

It is yet another object of the present invention to provide surface mount electrical connectors that can be efficiently mounted on printed circuit boards while substantially eliminating all waste due to damage to such connectors.

It is a further object of the present invention to provide surface mount electrical connectors of the type mentioned in the previous objects that can be in the forms, for example, of mounting posts, test points, IDCs, female receptacles and jumpers.

It is still a further object of the present invention to provide surface mount electrical connectors of the type aforementioned that can be inexpensively produced by using continuous stamping technology and without the need for individual packages or tapes to carry the conductors.

The present invention provides a new family of surface mount terminals that can readily and efficiently be utilized with associated feeders for use with pick-and-place equipment to eliminate the need for the combination surface mount/through-hole technologies.

In accordance with the present invention, a surface mount contact for surface mounting on a generally flat conductor surface of a printed circuit board comprises a base defining a plane and having a generally flat surface suitable for contact with and attachment to an associated flat conductive surface of the printed circuit board. The contact has at least one portion projecting from said base in a direction substantially normal to said plane defined by said base. At least one bent intermediate connecting portion integrally connects said at least one portion to said base, said at least one portion, base and at least one bent intermediate connecting portion all being integrally formed of a generally flat sheet of conductive material. Said at least one portion of the contact may be in the form of an electrical pin, a test point, an electrical female receptacle, an electrical insulation displacement connector (IDC) or a conductive link or jumper.

In order to provide a positive engagement between a vacuum nozzle of a surface mounting machine and the surface mount contact to be place on the printed circuit board, the surface mount contact comprises a first conductive portion arranged in a plane and dimensioned to be positioned on a conductive pad on which the contact is to be mounted. A second conductive portion is integrally formed with said first conductive portion and extends to one side of the plane, at least one of said portions being provided with a generally flat pick-up surface that can be engaged by the vacuum nozzle of the surface mounting equipment for positive engagement of the contact by the vacuum nozzle. Typically, connecting means are provided for connecting said surface mount contacts in a continuous strip of series-connected surface mount contact A. The connecting means is severable to permit selective detachment of one surface mount contact from said continuous strip by the surface mounting equipment for surface mounting on the conductive pads by engagement of said pick-up surface by the vacuum nozzle. Such contacts are made in the form of surface mount jumpers or other surface mount connectors.

When used with automated pick-and-place machinery, a strip of series connected surface mounted contacts are provided with frangible connecting means between each two adjacent contacts. In this manner, a strip of contacts can be advanced to an automated mounting station and a contact at the downstream end of the strip can be separated from the strip by severing said frangible connecting means between said contact at the downstream end and the adjacent immediately succeeding contact in the strip. Preferably, the series connected surface mount contacts are helically wound on a spool or bobbin so that the strip can be unwound and advanced to an automated mounting station.

The present invention also contemplates blanks for forming a surface mounted contact and a plurality of series-connected surface mounted contacts in accordance with the present invention, as well as the method of forming such contacts.

This invention consists of a specially designed jumper to eliminate the need for taping of the jumpers. The jumpers are stamped in a continuous strip form. There is a small connecting tab which connects the individual jumpers to each other to form a continuous strip. This connecting tab is an integral part of the jumper. Other contacts are disclosed that also provide flat pick-up surfaces for positive engagement with a vacuum pick-up nozzle and which can be produced from a continuous strip of conductive sheet material and formed into coiled reels for automated use on pick-and place machines.

The continuous strip is wound on a reel. The reel is mounted on a special feeding system which shears off one single jumper or other contact from the continuous strip and presents it to the vacuum pick-up nozzle at the proper place and time. That special feeding system is described in detail in U.S. Pat. Ser. No. 5,449,265 and U.S. patent application Ser. No. 08/395,822, both assigned to the assignee of the subject invention.

BRIEF DESCRIPTION OF THE DRAWINGS

This and other objects and features of the present invention will become clear from the following description taken in conjunction with preferred embodiments thereof with reference to accompanying drawings, in which:

FIG. 7A is similar to FIG. 7, but showing a configuration of an IDC and supporting base to permit passage of a vacuum nozzle through an opening in the IDC connector to positively engage a flat pick-up surface on the surface mount base;

FIG. 15 is a front elevational view of a further embodiment of a surface mounted connection in accordance with the present invention in the nature of a fuse holder;

FIG. 15A is a top plan view of a pair of fuse holders of the type shown in FIG. 15, illustrating how the connectors are joined to each other in a strip and illustrating holes formed in the bases of the connectors to enhance capillary action during soldering on a printed circuit board;

FIG. 15B is a perspective view of the fuse holder shown in FIG. 15, showing the manner in which a vacuum nozzle can pass between appropriately spaced fuse holder clips to positively engage a flat pick-up surface on the surface mount base;

FIG. 17 is a perspective view of one of the jumpers, after being separated from the strip shown in FIG. 16, positively engaged by a vacuum nozzle just prior to being placed on a printed circuit board; and FIG. 18 is a perspective view of a spool of surface mounted pins in accordance with the prior art wherein individual pins are contained within pocket carriers serially mounted on a tape helically wound on a reel.

DESCRIPTION OF THE PREFERRED EMBODIMENTS

Figure 1:
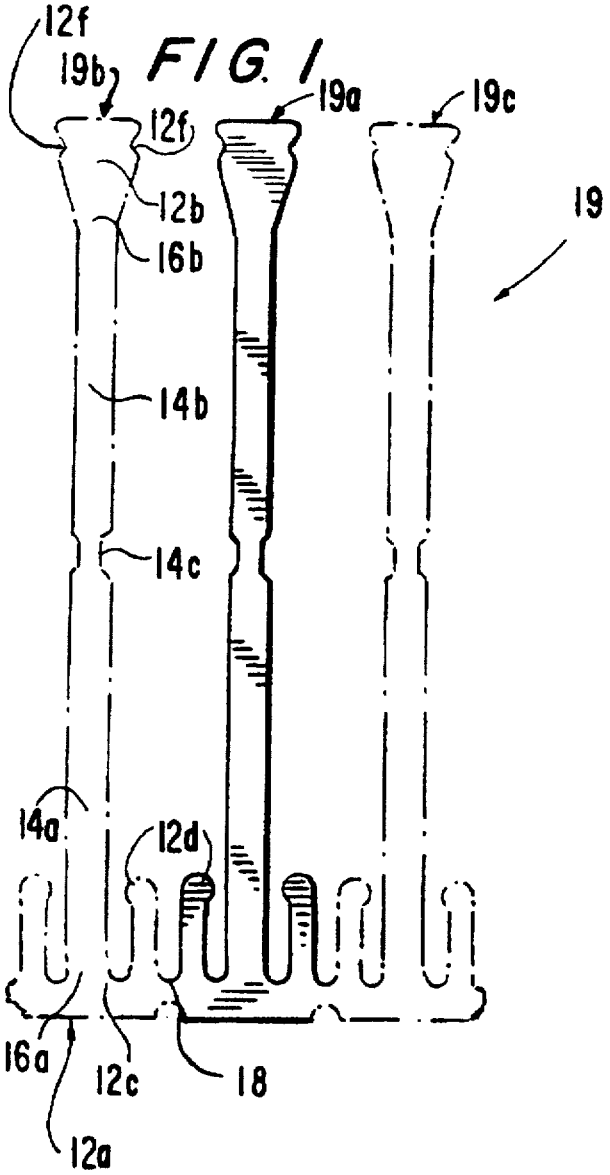
FIG. 1 is a perspective view of a surface mounted connector in the nature of a test point or male contact pin in accordance with the present invention, shown in its individual form after being severed from a strip of such connectors and ready to be surface mounted on a printed circuit board.

Referring now specifically to the Figures, in which identical or similar parts are designated by the same reference numerals throughout, and first referring to FIG. 1, an electrical connector or contact suitable for mounting on the surface of a printed circuit board (PCB) is generally designated by the reference numeral 10.

The connector 10 includes a base 12 which defines a plane and has a generally flat surface suitable for contact with and attachment to a flat conductive surface of a printed circuit board frequently referred to as a "land" or "pad". An electrical contact pin 14 has at least one portion projecting from the base 12 in a direction substantially normal to the plane defined by the base. At least one bent intermediate connecting portion integrally connects the contact 14 to the base 12. In the construction shown in FIG. 1, two intermediate bent connecting portions 16*a* and 16*b* respectively connect the first contact portion 14*a* to a first base portion 12*a* and a second contact portion 14*b* to a second base portion 12*b*.

The uppermost ends of the first and second contact portions 14*a*, 14*b*, which are juxtaposed to each other as indicated, are joined to each other by an integral bent bridging portion 14*c*. The juxtaposition of the contact portions 14*a*, 14*b* as shown creates a narrow gap or space 14*d* which permits the surface mounted pin design to take advantage of capillary action during solder reflow. At least one of the two thin strips of 14*a*, 14*b* are plated and when the base 12 of the pin terminal is exposed to melted solder paste, the capillary attraction makes the liquid solder rise up inside the gap 14*d* to solder the two halves 14*a*, 14*d* together forming a solid pin that can be used either as a contact pin or test point. The designs of other surface mounted connectors in accordance with the invention that promote capillary action and the advantages thereof will be discussed below.

An important feature of the present invention is that the electrical contact, such as the contact pin 14 in FIG. 1, including the base 12 and the intermediate connecting portions 16*a*, 16*b*, is formed of a generally flat sheet of conductive material, as will now be discussed in connection with FIG. 2. Such construction allows for the economical manufacture of the surface mount electrical connectors and, equally importantly, it allows the connectors to be produced in elongate strips, as will be discussed hereafter, which facilitates the accurate positioning of the electrical connectors in pick-and-place equipment and to make such connectors viable and practical to use with such equipment.

Figure 2:
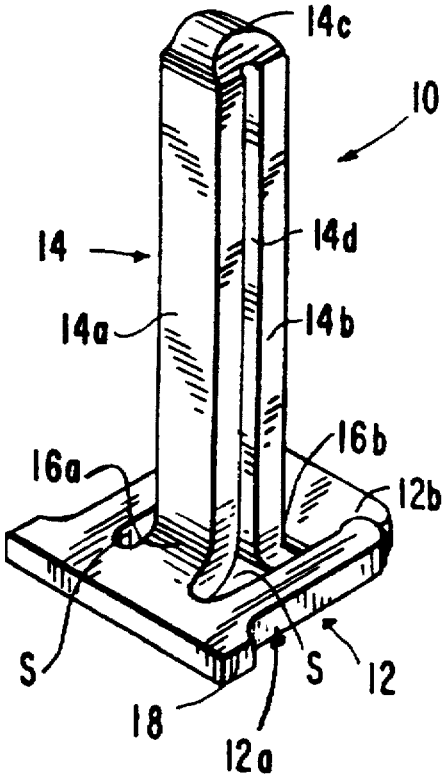
FIG. 2 is a plan view of a blank for a plurality of series-connected surface mounted connectors of the type shown in FIG. 1, showing one connector in solid outline, while downstream and upstream connectors in relation thereto are shown in phantom outline.

Referring to FIG. 2, a blank 19 is illustrated from which the connector 10 of FIG. 1 is made. The blank 19 is preferably for a plurality of series connected surface mounted connectors, as shown, which is formed as a stamping from an elongated strip of a flat sheet of electrically conducted material which includes like blank portions successively stamped along the strip as shown. Only the center blank 19*a* is shown in solid outline, a downstream immediately adjacent blank 19*b* and an upstream adjacent blank 19*c* being illustrated in phantom outline. All the blanks are similarly constructed and joined to each other by a frangible connecting tab strip or carrier 18 which connect adjacent blanks to each other. Each blank generally includes a base suitable for attachment to an associated surface of a printed circuit board, a contact and at least one intermediate connecting portion integrally connecting the contact to the base, as aforementioned in connection with FIG. 1. In connection with the specific blank shown in FIG. 2, utilized to produce the contact pin 14 of FIG. 1, the first base portion 12*a* is shown to include a generally U-shaped member having two parallel segments 12*c* on opposite sides of the contact portion 14*a*, and each having inwardly projecting protuberances 12*d* as shown. The two parallel segments 12*c* are joined to a transverse segment 12*e*, which is also joined, at its center, with the contact portion 14*a* by means of the intermediate connecting portion 16*a*. The bridging portion 14*c* is shown as a narrowed or necked down portion between the first and second contact portions 14*a*, 14*b*. At the upper or free ends of the contact portions, as viewed in FIG. 2, the second base portion 12*b* is provided as an outwardly tapered portion provided with opposing or lateral indentations 12*f*. As is clear from FIG. 1, the dimensions of the second base portion 12*b* are selected so as to be received within and substantially fill the area between the segments 12*c* when the base portions 12*a*, 12*b* are all moved into a common plane of the base 12.

Once the blanks have been formed, as shown in FIG. 2, the surface mounted connector 10is formed by deforming the blank so as to impart an approximately 90° bend in the first intermediate connecting portion 16*a*, thereby moving the first base portion 12 into a plane substantially normal to the first contact portion 14*a*. The second contact portion 14*b* is then bent 180° in relation to the first contact portion 14a about the bridging portion 14c so as to bring the contact portions 14a and 14b into juxtaposed position as shown in FIG. 1. Finally, the second base portion 12b is moved into the plane of the first base portion 12a, by imparting a bend of 90° to the second intermediate connecting portion 16b, and positioning the protuberances 12d into the indentations of 12f as shown in FIG. 1. Other surface mounted connectors can be formed by the steps of forming a blank as described or by slightly modified steps as will be from the description that follows to those skilled in the art to apply the present invention to numerous other surface mounted connector designs.

It will be appreciated that the combination of protuberances 12d and indentations 12f provide a locking mechanism which prevents the first and second base portions 12a, 12b and first and second contact portion 14a, 14b from separating, particularly prior to assembly or mounting on a printed circuit board. The design maintains the integrity of the contact pin or test point in its desired configuration during processing in the pick and place equipment, including severing a connector from the strip, gripping the connector at the pick up point, and placing the connector on a land on the printed circuit board to which it is to be soldered. Therefore, even though the connector is stamped from flexible sheet material, which exhibits some resiliency or "memory", the connector enjoys the advantages of a solid pin. Of course, after the connector 10 has been soldered to a printed circuit board, the contact portions 14a, 14b effectively become a solid pin by virtue of the capillary action of the solder which flows into and fills the gap or space 14d.

The flat base 12 of the embodiments of FIGS. 1 and 2 is preferably square in configuration, to conform to lands or pads on printed circuit boards which frequently are also square. However, this is not a critical feature of the present invention and it should be clear that the area defined by the flat base 12 can be any desired or selected area by selecting by appropriate dimensions for the various base portions which have been described. Also, with the base configuration shown in FIGS. 1 and 2, it will be appreciated that with exception of the central area, the flat base 12 presents a substantially solid surface for providing significant contact and adhesion to a land or pad on the printed circuit board. However, there are provided at least some open regions S in the center of the base. As suggested above, the solder will, by capillary action, rise into the open spaces "S" and into the pin 14 and, therefore, also provide adhesion to the printed circuit board in that central region. Preferably, in all the designs utilizing the present invention, the bases of the connectors exhibit substantial solid metal surfaces provided with openings or apertures S that are relatively small to take full advantage or benefit from capillary action, so that the connectors can be drawn to and attached to the printed circuit board when the solder reflows into the spaces S. This generally occurs with minimum float or lateral shifting because the rising of the reflowing solder draws the base towards the surface of the PCB with an effect not unlike a suction-cup effect. This is important because the pick-and-place equipment provides the greatest precision in the surface mounting process and the undesired shifting of components during reflow of the solder may misalign a component after accurately placed by the machine. The flow of solder into spaces S of the bases or into the space or gap 14d of the contact pin 14 (FIG. 1), which effectively "absorb excess solder, to draw the bases to the PCB surfaces, has the additional advantage of rendering tolerances of the base and PCB land or pad dimensions less critical.

The spaces S (or gap 14d) should have dimensions that will provide capillary action, as aforementioned. Such dimensions will depend on numerous factors, including the nature of the solder paste, how clean and large the board and/or the contact surface area is, how level the board is, etc. Numerous technical papers have been written about the properties of solder that deal with the related topics of surface tension, wetting angles and capillary action. See, for example, "University Physics," Sears and Zemansky, 2nd Edition, Addison-Wesley Publishing Company, Inc., 1957, pages 231–235; "Testing SMDs for Solderability," B. M. Allen, "Surface Mount Technology" Oct. 1988, pps 17–18; "The Assessment of the Solderability of Surface Mounted Devices Using the Wetting Balance", Yoshida et al, International Tin Research Institute Report. Those skilled in the art can, knowing all the relevant factors, determine what those dimensions should be. The number of spaces S, their dimensions, and/or their arrangement is not critical as long as they provide the desired capillary action.

Figure 3:
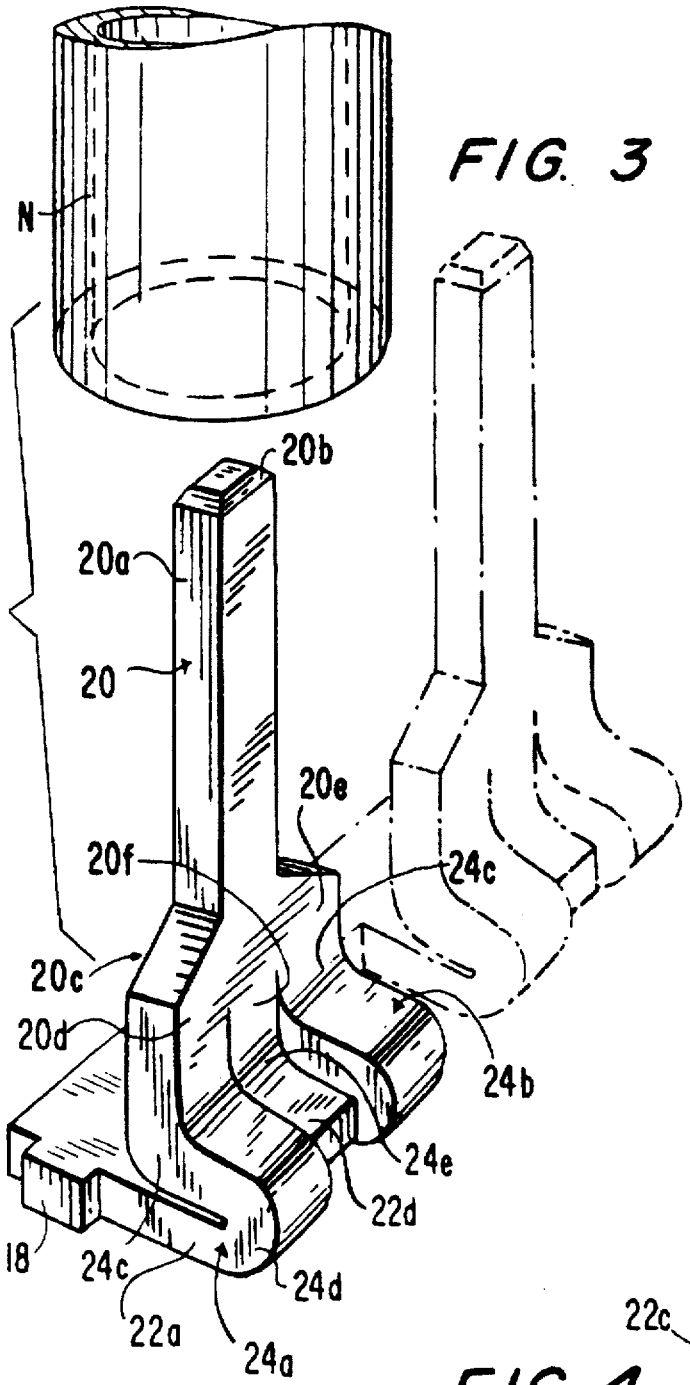
FIG. 3 is a perspective view of another embodiment of a surface mounted connector in accordance with the present invention, also in the form of a contact pin, and schematically illustrating a vacuum pick up nozzle positioned over the connector at the downstream end of the strip for picking up the connector after being severed from the strip.
Figure 4:
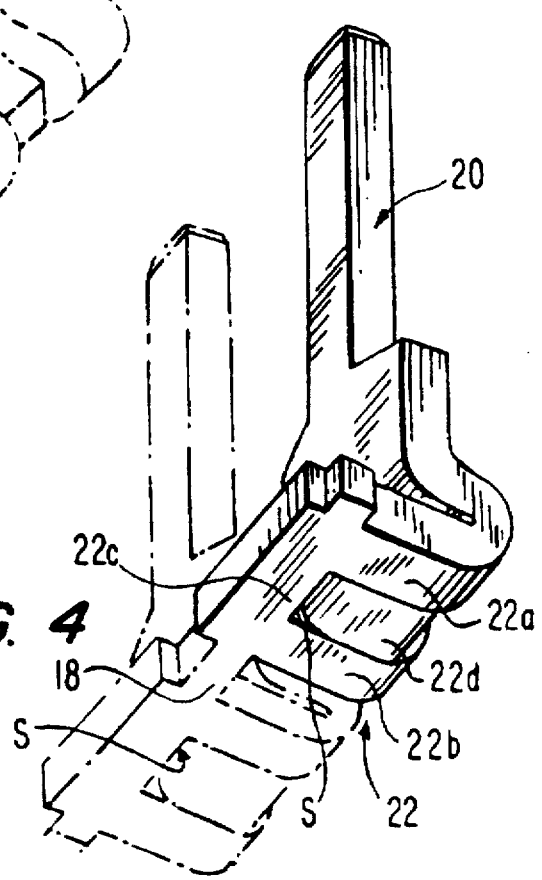
FIG. 4 is a bottom perspective view of the connector shown in FIG. 3, showing the details of the base construction as well as the manner in which the connectors are joined to each other by means of connecting tabs or carrier strips.

Referring to FIGS. 3 and 4, another embodiment in accordance with the invention is shown in the form of a contact pin 20. The contact pin 20 includes an upper contact member 20a which is advantageously provided with a beveled upper or free end 20b to facilitate insertion into a female contact receptacle. The base 22, as with the embodiment shown in FIGS. 1 and 2, is generally U-shaped and includes parallel spaced portions 22a, 22b, transverse portion 22c and solder absorbing space S as shown. The upper contact member 20a, in the region of the base 22, flares out or widens to the width of the base 22 as shown and defines a plurality of depending portions which are substantially co-planer with the central contact member 20a. In FIGS. 3 and 4, the enlarged shoulder 20c includes first and second side depending portions 20d, 20e and a center depending portion 20f. A separate bent intermediate connecting portion connects each of the depending portions with an associated base portion. Thus, the first side depending portion 20d is connected to the base portion 22a by connecting portion 24a, which includes first and second bent portions 24c, 24d. Similarly, connecting portion 24b connects the side depending portion 20e to the base portion 22b. In order to maximize the area or contact surface of the base with the printed circuit board and provide a solder-receiving space S, the center base portion 22d, which is an extension of the center depending portion 20f, joined at the bent portion 24e. Bent portions 24c and 24e are bent 90°, while bent portions 24d are bent 180° as shown. As with the contact pin 14, the bases are joined to each other by means of connecting or carrier tabs 18 which are selectively severed when the connector at the downstream end of the strip is about to be picked up by the mounting equipment, as suggested by the vacuum pick up nozzle N in FIG. 3.

Figure 5:
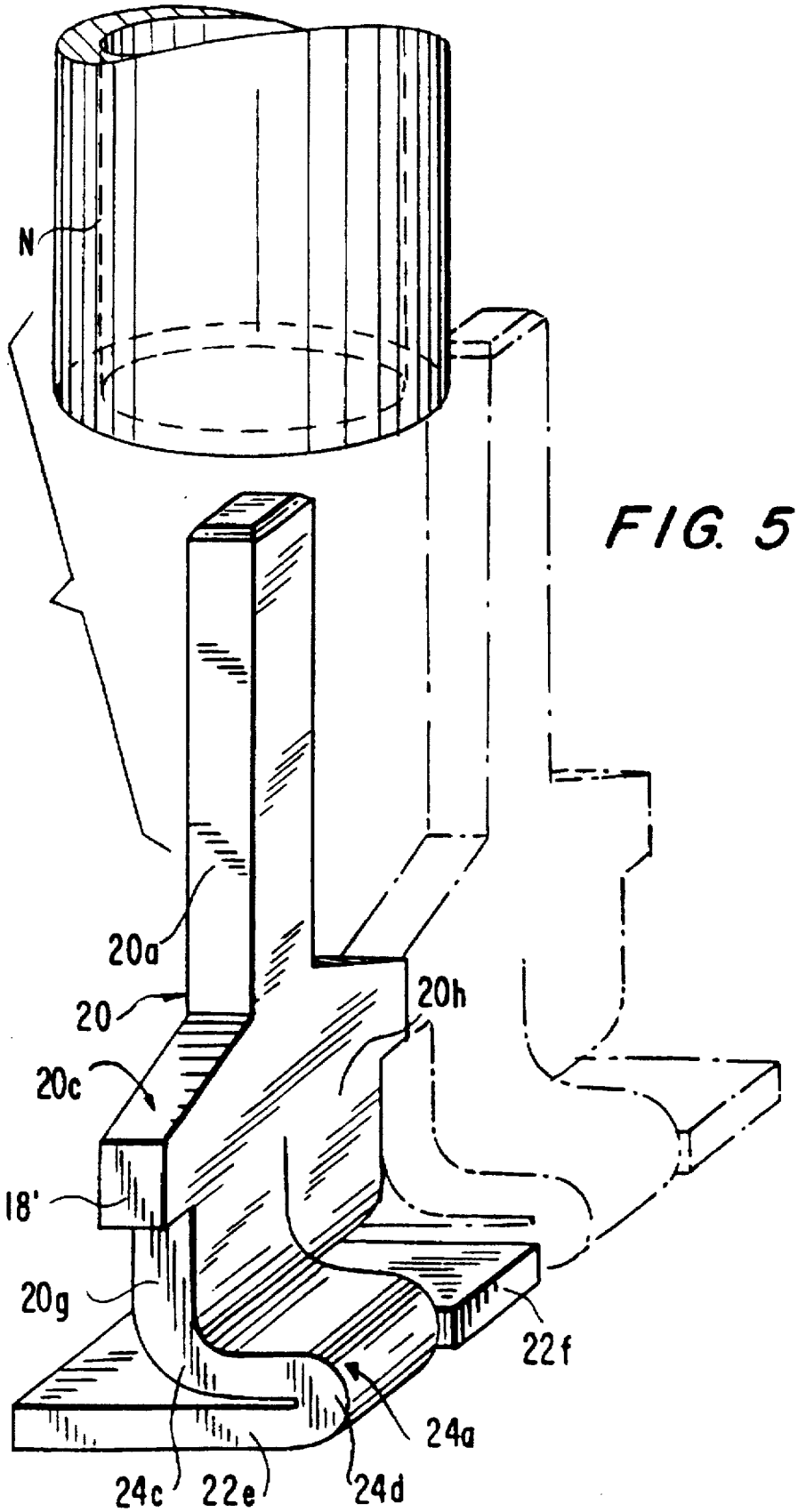
FIG. 5 is similar to FIG. 3, but showing a still further embodiment of a surface mounted connector in accordance with the present invention, in which adjacent connectors in the strip are joined to each other at a portion of the contact pins instead of at the bases.

In FIG. 5, a pin generally similar to that shown in FIGS. 3 and 4 is illustrated, except that only two base portions are provided. Thus, the enlarged shoulder portion 20c is configured as shown in order to provide a first depending portion 20g and second depending portion 20h. While the connecting portions 24a are both arranged on the same side of the contact pin 20 in FIG. 3, the connecting portions 24a are arranged on opposite sides of the contact pin 20a in FIG. 5. Thus, only two base portions 22e and 22f are provided, each respectively joined to one of the two depending portions and joined thereto by means of bent portions 24d and 24e which are respectively bent 180° and 90° as with the connecting portions in FIG. 3.

With the embodiment shown in FIG. 5, the total width of the two depending portions 20g and 20h are less than the width of the enlarged shoulder portion 20c to provide lateral connecting tabs or carrier strips 18', so that adjacent connectors are severed by severing them at the shoulder portions instead of at the bases as is the case with the embodiments shown in FIGS. 1–4. It should be clear, therefore, that the specific locations of the connecting tabs or carrier strips is not critical for purposes of the present invention, and the specific locations of the carrier strips or connecting tabs will least to some extent be a function of the pick and place equipment and, in particular, the design of the feeder used to feed the connectors to the pick and place equipment.

Figure 6:
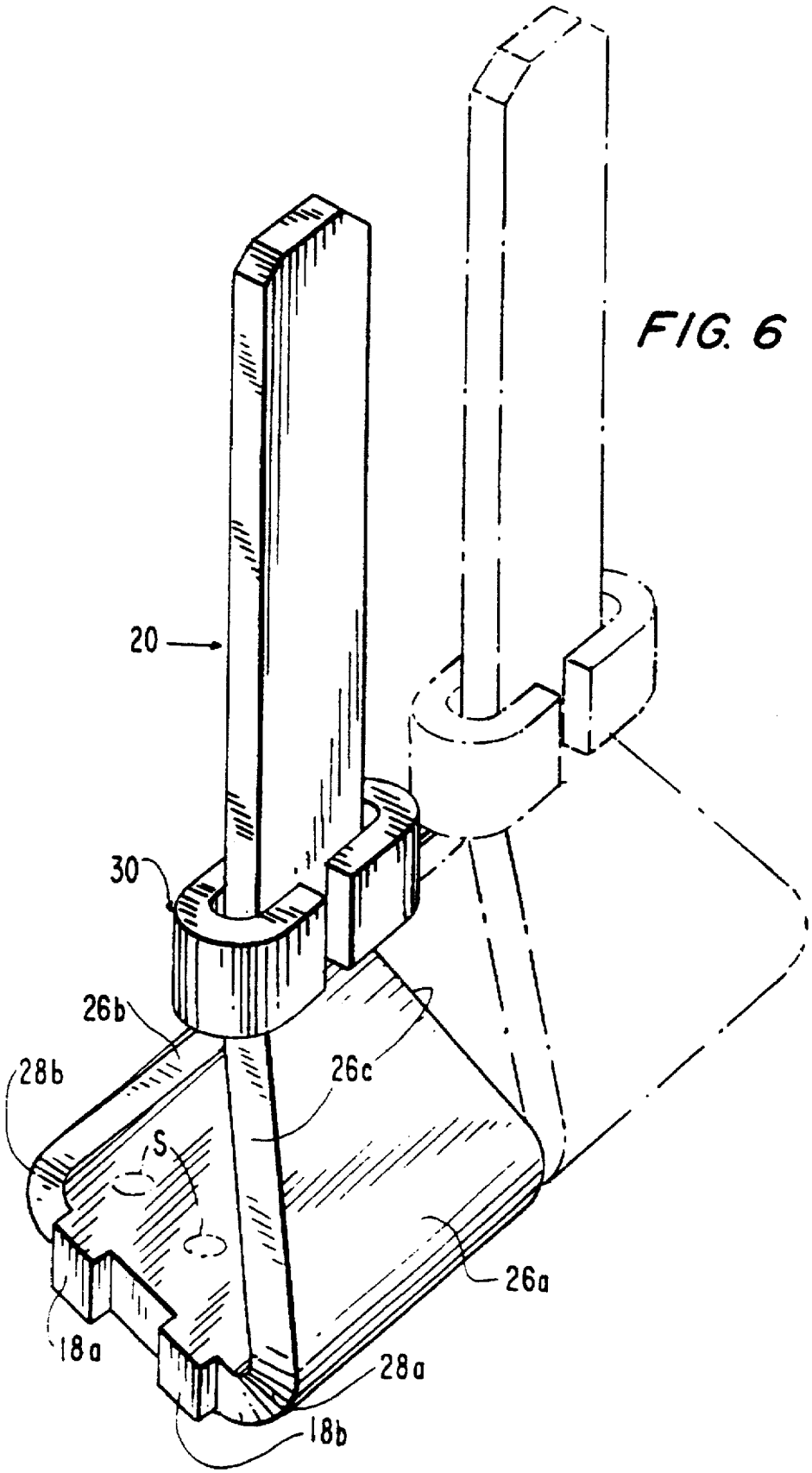
FIG. 6 is yet a further embodiment of a surface mounted connector in accordance with the present invention, in which adjacent connectors are joined to each other by a double set of carrier strips and illustrating a construction for stabilizing the contact pin.

In FIG. 6, a still further contact pin design is illustrated which is similar in certain respects to the pins shown in FIGS. 3–5. However, in FIG. 6, the base 26 is formed of a solid portion of the strip and defines a pair of opposing sides (at the bent portions 28a, 28b). The contact pin 20 is positioned generally centrally of the rectangular area defined by the base 26. One bent intermediate connecting portion 26a extends from one side of the base 26, as shown, to the contact pin 20 and another intermediate connecting portion 26b extends from the other side of the base to a point proximate to the contact pin 20. A tab or collar 30 is provided which is crimped about the contact pin 20 as shown. In this manner, the intermediate connecting portions 26a, 26b stabilize the position of the contact pin 20. Also in FIG. 6, the bases 26 are shown to include a pair of spaced connecting tabs or carrier strips 18a, 18b, although, clearly, one or more such carrier strips can be provided depending on the equipment to be used and the manner in which the tabs are to be fed to the pick and place equipment. Shown in fanthom are optional holes S in the base 26 to absorb solder during reflow, for reasons discussed above.

Figure 7:
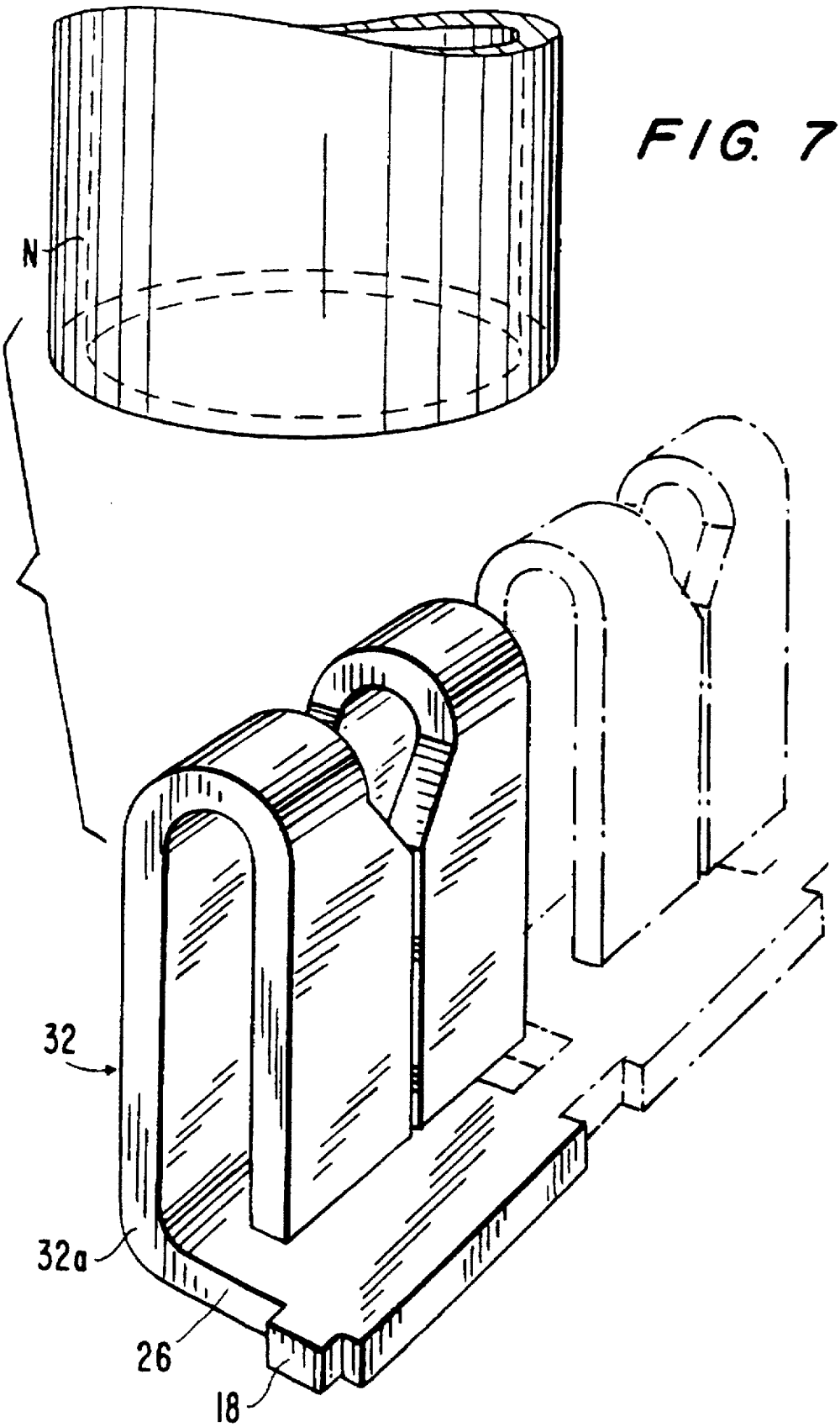
FIG. 7 is similar to FIGS. 3 and 5, but illustrating a surface mounted connector in accordance with the present invention in the form of an insulation displacement connector
Figure 8:
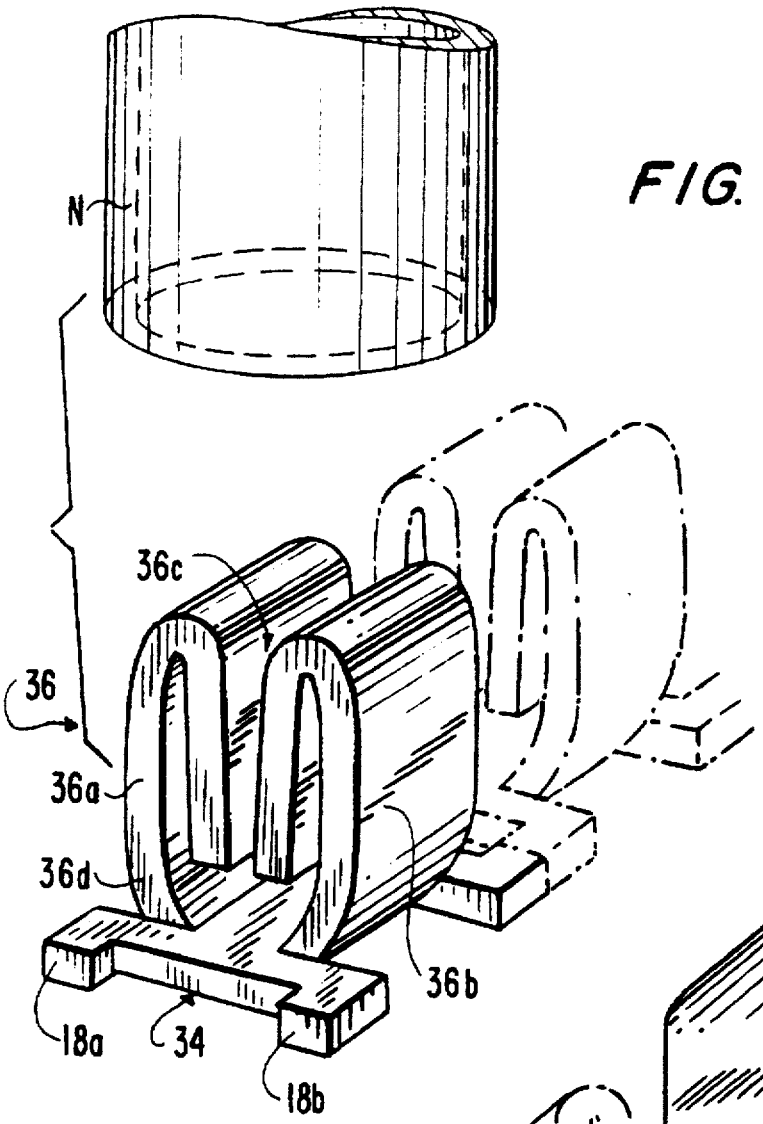
FIG. 8 is similar to FIG. 7, but illustrating a female receptacle for surface mounting in accordance with the present invention.
Figure 9:
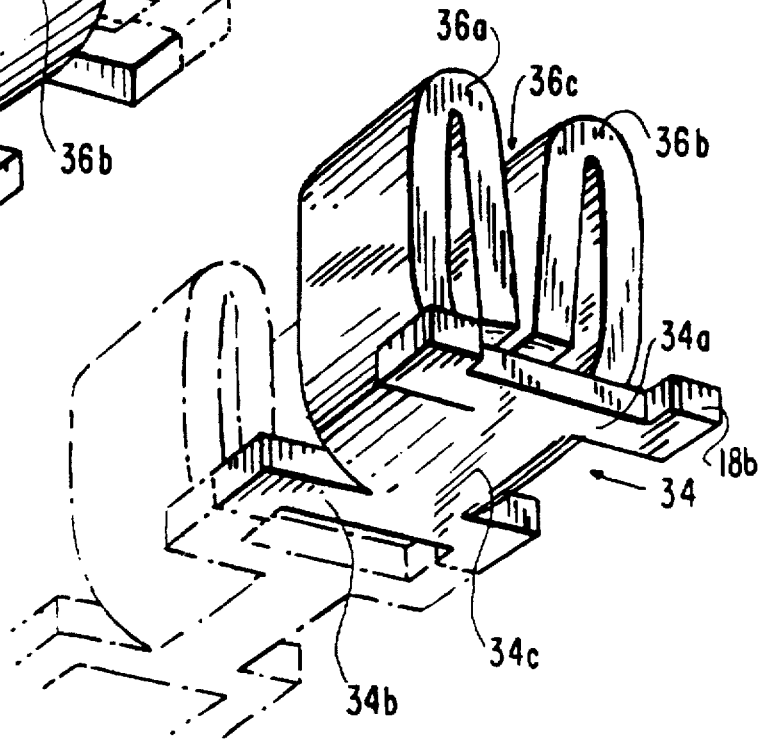
FIG. 9 is a bottom perspective view of the connector shown in FIG. 8 to illustrate details of the base and the manner in which adjacent connectors are joined to each other.

The present invention is not limited to generally elongate contact pins, posts or test points of the type described in FIGS. 1–6. FIG. 7 illustrates an embodiment of the invention in which the contact is in the form of an insulation displacement connector (IDC) 32 connected to the solid base 26 by means of intermediate bent connecting portion 32a. The construction of the IDC portion 32 is well known to those skilled in the an. Similarly, in FIG. 8, another type of surface mounted connector is illustrated in the form of a female tab receptacle 36 which includes first and second resilient prongs 36a, 36b spaced from each other as shown to provide a flat tab receiving space 36c. The prongs 36a and 36b are joined to the base 34, as best shown in FIG. 9. The base 34 is I-shaped and includes transverse base portions 34a, 34b and a center base portion 34c. Each of the prongs 36a, 36b are joined to the center base portion 34c, each of the transverse base portions 34a, 34b carrying two connecting tabs or carrier strips 18a, 18b, as shown.

Figure 10:
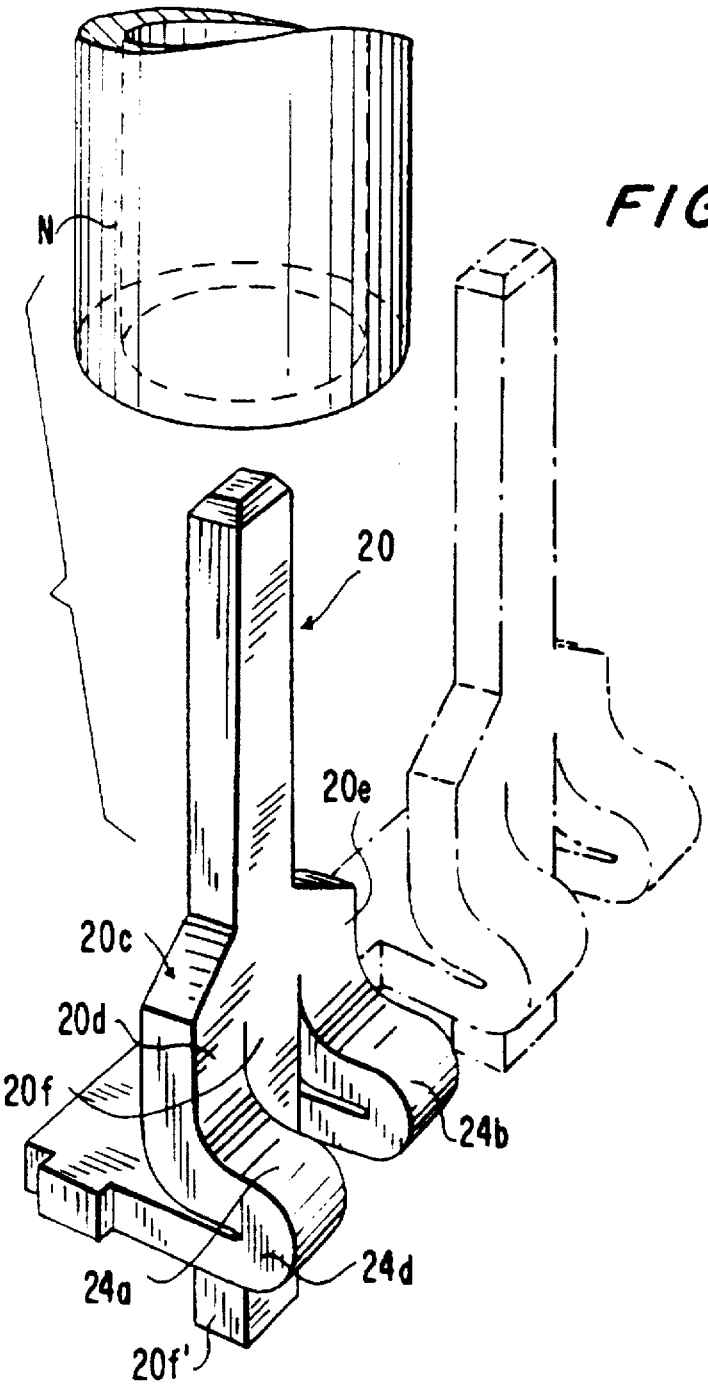
FIG. 10 is similar to FIG. 3, but showing a variant form of the connector which includes a downwardly extending post.
Figure 11:
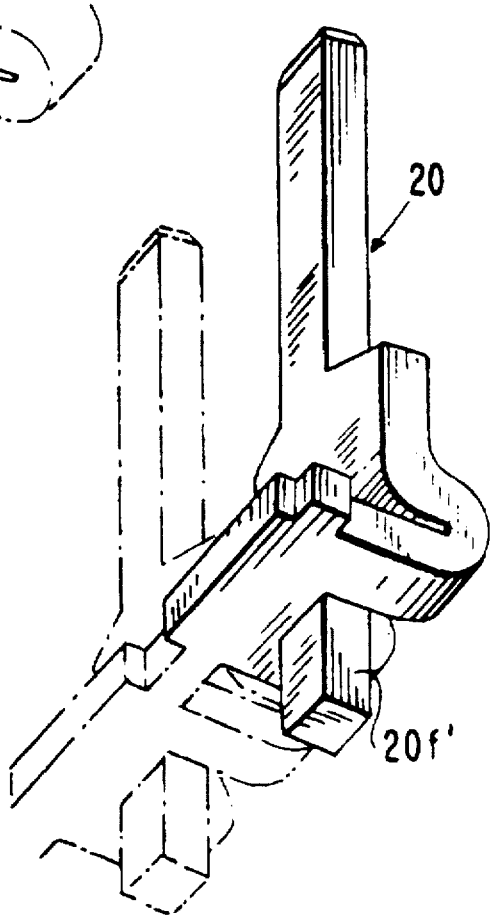
FIG. 11 is a bottom perspective view of the connectors shown in FIG. 10.
Figure 12:
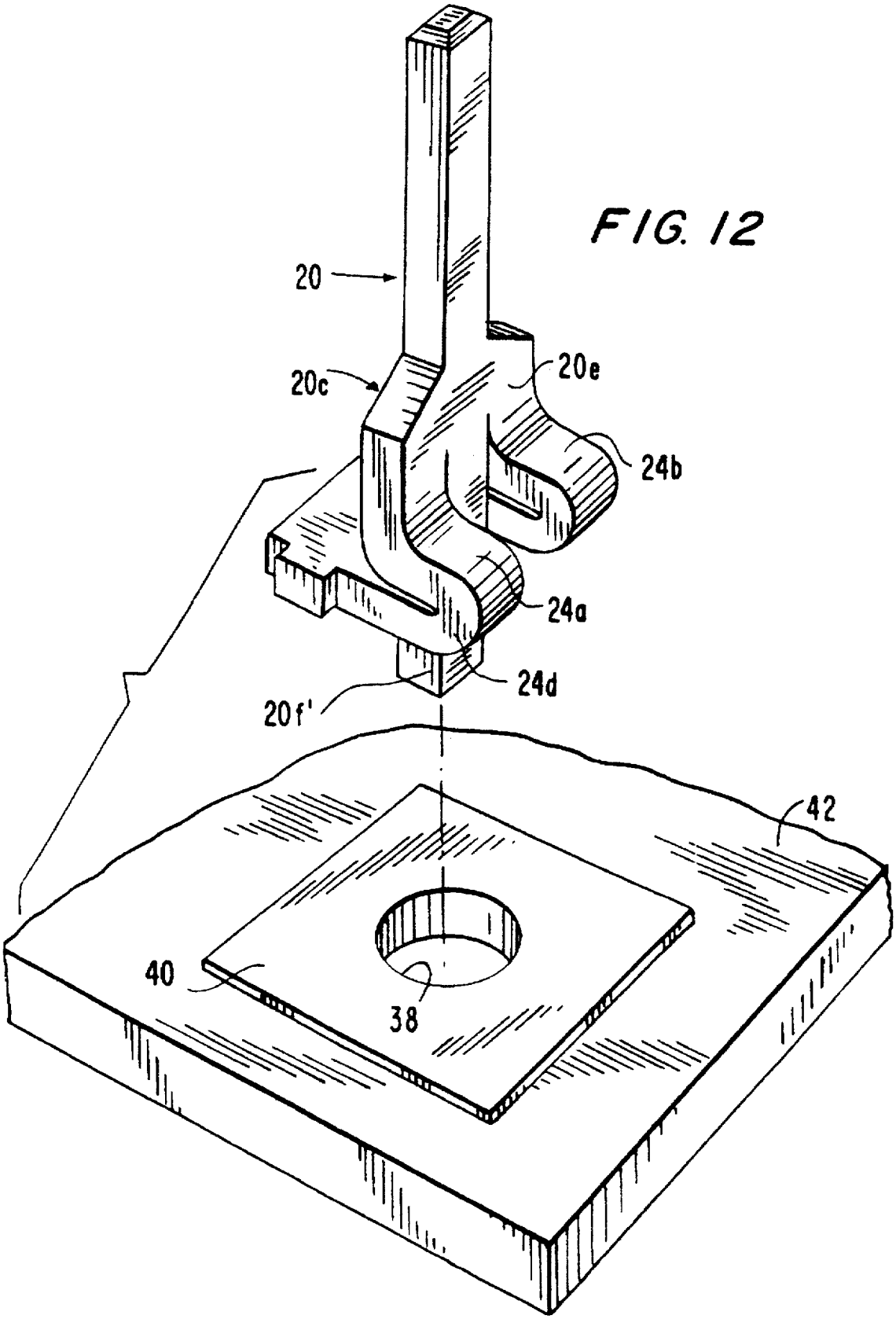
FIG. 12 is an exploded perspective view showing a surface mounted connector of the type shown in FIGS. 10 and 11 just prior to mounting on a printed circuit board which includes a through opening for the post of the connector.

Referring to FIGS. 10–12, a variant of the surface mounted connector in the form of a contact pin is illustrated which is similar in construction to the pin connector shown in FIG. 3. However, instead of the center depending portion 20f being bent as shown in FIG. 3 to provide a center base portion 22d, the center dependent portion 20f extends straight downwardly co-extensively with the contact pin 20 to form a downwardly extending post 20f' which can be received within a through opening 38 formed in a conductive land or pad of a printed circuit board 42, as shown in FIG. 12. The post or anchor pin protudes downwardly from the flat mounting base. The solder pads 40 of the PCB must have a hole in the center 38 as shown. When the terminal or connector is placed on the side of the paste covered solder pad the anchor post 20f' enters into the hole or opening 38 and limits the terminal from floating while the solder is reflowed. In most cases, undesired floating is almost totally eliminated as a result of the absorption of solder into spaces S by capillary action as described above.

Figure 13:
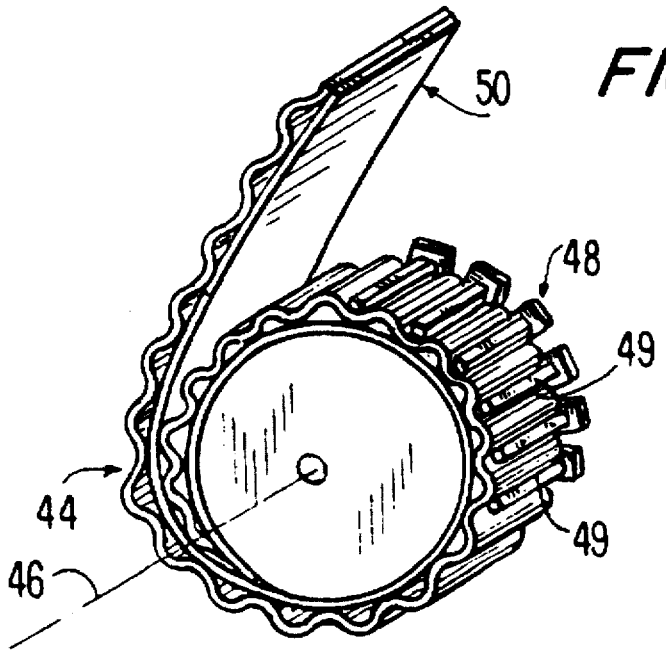
FIG. 13 is a perspective view of a rolled strip of connectors of the type illustrated in FIG. 1, illustrating the orientations of the connectors helically wound on a reel and an interleaf or spacer member for separating adjacent layers of the helical winding.

In FIG. 13, a rolled strip of series-connected surface mounted connectors for automated mounting on a surface of a printed circuit board is illustrated and generally designated by the reference numeral 44. The spool or reel 44 includes a rotatable support member 45 which has an axis of rotation 46. As shown, the surface mounted connectors 48 are oriented so that the directions of the contacts 49 are substantially parallel to the axis of rotation 46 while the bases of the individual connectors are substantially arranged in a common or in parallel planes. The frangible connecting means in the form of connecting tabs or carrier strips are sufficiently flexible without breaking to allow the connectors 48 to be arranged along circular arcs when helically wound about the support member 45.

Figure 14:
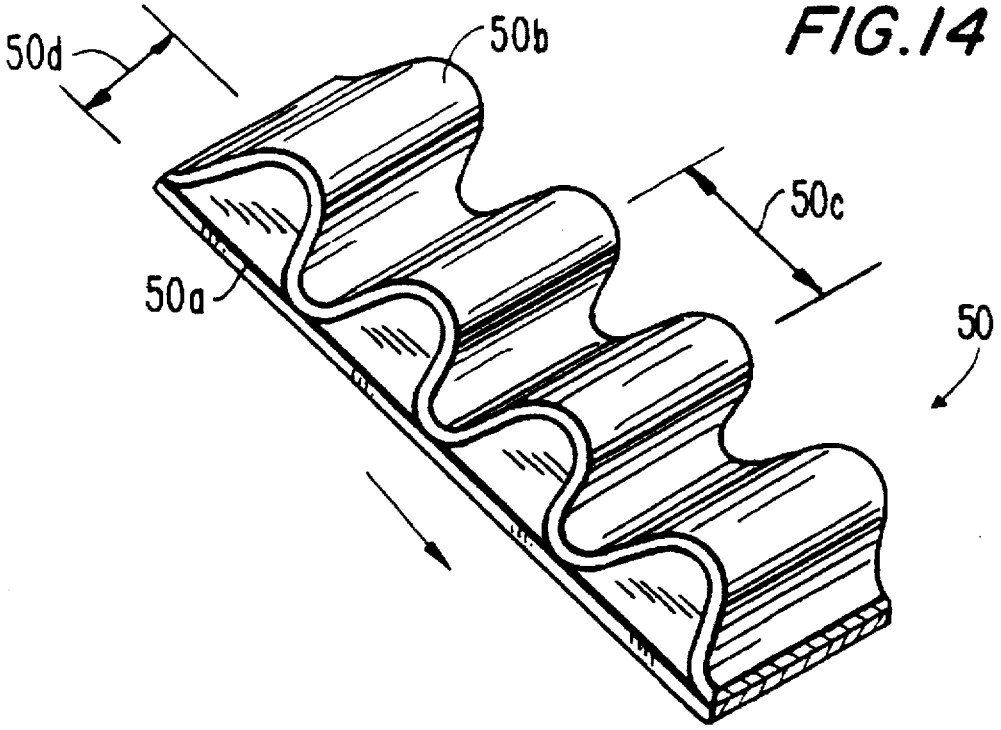
FIG. 14 is an enlarged perspective view of a section of the spacer member used in the rolled strip shown in FIG. 13.

Since the radial dimensions of the elongate contact pins (when wound on the spool or reel 44) are generally less than those of the bases of such connectors, it is preferred that a suitable spacer element be provided which is interleafed with the continuous helically wound strip of connectors for maintaining the electrical contacts in the desired parallel orientations as shown. Referring to FIG. 14, there is shown one form of spacer that can be used for maintaining the contacts 49 in adjacent layers spaced from each other at a distance to define a spiral connector-receiving space which has a radial dimension substantially equal to the radial dimension of the bases of the connectors. A suitably dimensioned spiral connector receiving space minimizes contact interference between the bases in adjacent layers. The illustrated spacer includes a continuous flat strip of flexible material 50a, and an undulating wave-like or corrugated strip of material 50b which is attached to the flat strip of material 50a as shown. The wave-like strip of material 50b has a peak-to-peak distance 50c along the length of the flat strip 50a which substantially corresponds to the distance between successive contacts 48 on the strip, and a peak-to-peak height 50d along a radial direction normal to the longitudinal direction of the flat strip which is substantially equal to the difference between the radial dimension of the bases and the dimension of the contacts 49 in the radial direction when helically wound on the rotatable support member 45. The spacer 50 normally secures the contacts on the reel. By unwinding the spacer during use, a section of the continuous strip can be unwound and fed to a pick and place machine. A spool or reel of the type shown in FIG. 13 can be mounted on a feeder of the type shown and described in U.S. Pat. No. 5,449,265 and U.S. patent application Ser. No. 08/395,822 both assigned to the assignee of the present invention. The specific construction of the spacer 50 is not critical and, in theory, the continuous strip of surface mounted connectors can be helically wound without the use of a spacer or simply separated by a continuous strip of flat sheet material. However, the use of the spacer maintains the desired orientations of the connectors 48 and prevents the connecting tabs or carrier strips from becoming damaged or severed.

In FIGS. 15 and 15A a further embodiment is illustrated which incorporates the invention and is in the form of a fuse holder 60. The fuse holder 60 has a base 62 similar to the base shown in FIGS. 8 and 9. Spring clips 60a, 60b extend normally from the base and integrally joined thereto at bent portions 64a, 64b as shown. As with the other surface connectors, the bases are preferably provided with apertures or opening S for receiving solder by capillary action. Some solder will also enter the spaces S' in the regions of the bent portions 64a, 64b.

Figure 16:
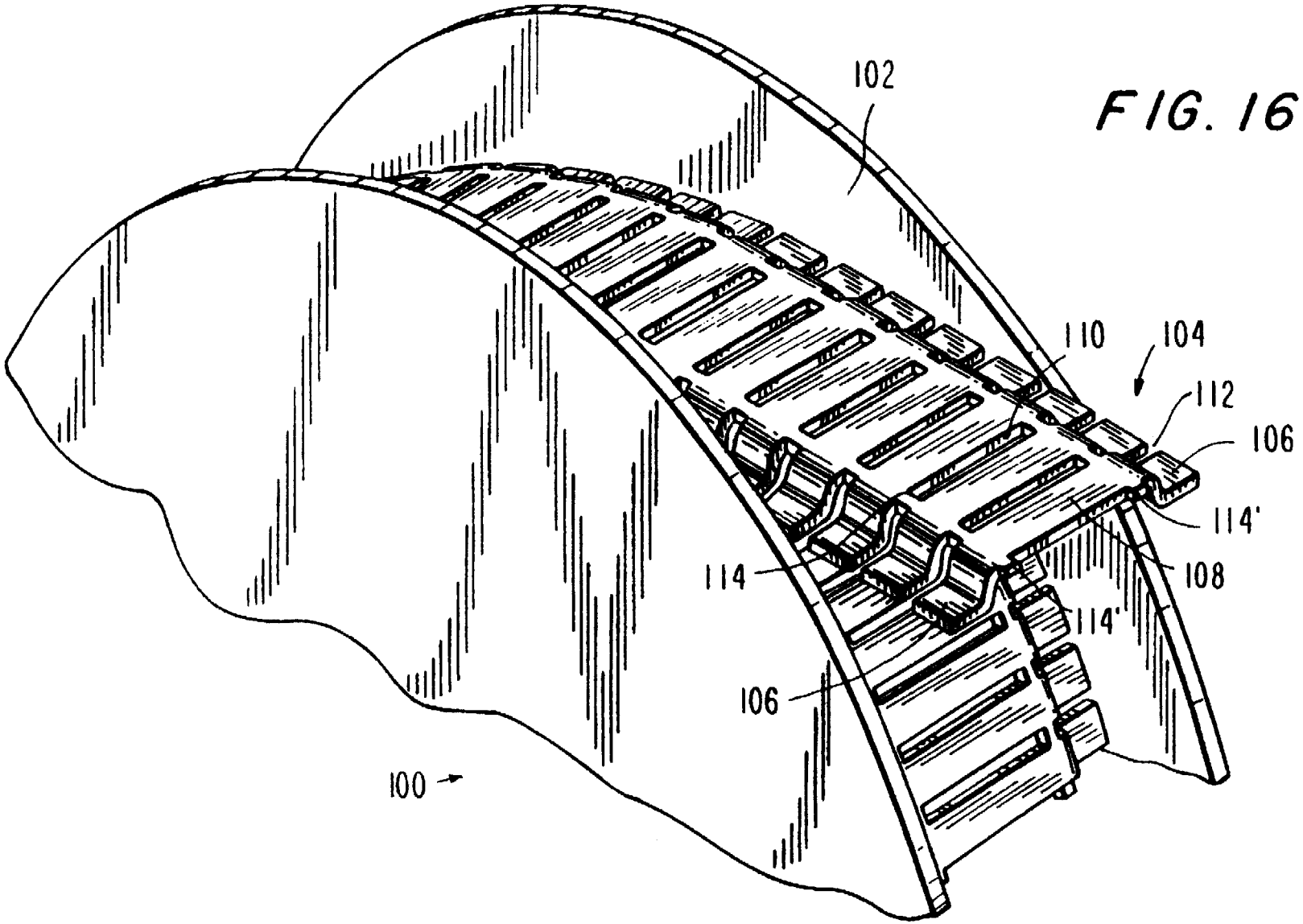
FIG. 16 is a perspective view of a continuous strip of series-connected jumpers in accordance with the invention shown wound on a dispensing reel.

While a number of the aforementioned surface mount contacts are dimensioned and configurated to require a generally large Nozzle (e.g. see FIGS. 7 and 8) in order to receive the upwardly projecting or contact portions which project from the bases on which the contacts are mounted on the printed circuit board, a class of surface mount contacts can take advantage of generally smaller nozzle sizes and provide a more positive pick-up by providing a generally flat pick-up surface on the contact that can be engaged by the vacuum nozzle of the surface mount equipment. In its broadest aspects, such surface mount contacts comprise a first conductive portion arranged in a plane and dimensioned to be positioned on a conductive pad on which the contact is to be mounted. A second conductive portion is integrally formed with said first conductive portion and extends to one side of the plane, at least one of said portions being provided with a generally flat pick-up surface that can be engaged by the vacuum nozzle on a surface mounting equipment. One example of such contact is a surface mount jumper. Referring to FIGS. 16 and 17 a continuous strip of series-connected jumpers of this type is generally indicated by the reference numeral 100. The jumpers are wound in a coil on a reel 102 for automated feeding to surface mount equipment. Each individual jumper is designated by the reference numeral 104 which includes spaced leg portions 106 dimentioned to correspond to the dimensions of two spaced conductive pads 118 on a printed circuit board 116 on which the jumper is to be mounted. A second conductive portion 108 is in a form of a conductive linking portion generally offset from the plane of the leg portion 106 and arranged in a plane generally parallel to the plane of the leg portions 106 as shown and extending between the leg portions. The conductive linking portion 108 provides a generally flat pick-up surface, as illustrated in FIG. 17.

Preferably, the individual jumpers 104 are arranged in a continuous strip of series-connected surface mount jumpers, as illustrated, by means of suitable connecting means. In the embodiment illustrated, the connecting means are in the form of two spaced connecting tabs 114 which extend between adjacent jumpers. The tabs 114 are severable to permit selective detachment of one jumper from the continuous strip by the surface mounting equipment so that one of the jumpers can be mounted on the printed circuit board by its engagement by a pick up vacuum nozzle N. The stubs 114' are illustrated on the jumper following its severance from the rest of the strip by a suitable feeder of such continuous strip of electrical contacts or connectors to pick and place or surface mount equipment, as disclosed in U.S. Pat. No. 5,449,265 and U.S. patent application Ser. No. 08/395,822, both assigned to the assignee of the present invention.

While the illustrated jumpers 104 include two leg portions for being mounted on two spaced conductive pads 118, as shown in FIG. 17, it should be clear that jumpers with more than two legs are possible, in which case the legs would be arranged in a selected configuration within a plane to be set on a corresponding number of pads or lands on the printed circuit board, and the conductive linking portion would assume a suitable configuration to extend between and bridge the various leg portions to provide a common electrical contact therebetween.

The method of forming the continuous strip of jumpers 104 includes the steps of advancing a continuous strip of conductive sheet material. A plurality of transverse slits 110, 112 arranged in successive lines generally transverse to the advancing direction are formed as shown. The transverse slits 110, 112 are arranged to define the spaced leg portions 106 and the conductive linking portion 108 extending between the leg portions to generally arrange the leg portions in a common plane and the linking portions 108 in a plane offset from and generally parallel to said common plane.

Referring to FIG. 7A, a surface mount contact in the form of a surface mount IDC 120 is illustrated, wherein a first conductive portion comprises a generally flat base 122 dimensioned to correspond to a conductive pad on which the IDC connector is to be mounted. The IDC portion 124 of the contact is integrally formed with the base 122 at 126, and includes two IDC contact portions 130, 132 as shown which are spaced from each other to provide a conductor receiving opening 134. The upper surface of the base 122 provides a generally flat pick-up surface, the central opening 134 being dimensioned to permit the vacuum nozzle N to pass through it to engage the generally flat base portion 122.

A surface mount fuse clip 136 is illustrated in FIG. 15B which likewise includes a generally flat base 138 dimensioned to correspond to a conductive pin on which the clip contact is to be mounted and which provides a generally flat pick-up surface. Tabs 140 on the base represent the severed connecting strips between adjacent contacts when first formed as a continuous strip and fed to the surface mount equipment. The two clip contacts 142, 144 are sufficiently spaced from each other to provide access to the vacuum nozzle N to the base to permit engagement with the generally flat base portion 138.

Therefore it is clear that a whole class of surface mount contact relatively small pick-up nozzles, because the pick-up nozzles contacts or abuts against a flat pick-up surface, which enhances the vacuum suction. Not only are such smaller pick-up nozzles more conventional but they are more effective when contacting a small flat surface.

Although the present invention has fully been described in connection with the preferred embodiments thereof with reference to the accompanying drawings, it is to be noted that various changes and modifications are apparent to those skilled in the art. Such changes and modifications are to be understood as included within the scope of the present invention as defined in the claims that follow.

I claim:

1. Surface mount contact for mounting on a conductive pad on a printed circuit board by surface mounting equipment which includes a vacuum nozzle, the surface mount contact comprising a first conductive portion arranged in a plane and dimensioned to be positioned on a conductive pad on which the contact is to be mounted, a second conductive portion integrally formed with said first conductive portion and extending to one side of said plane, at least one of said portions being provided with a generally flat pick-up surface that can be engaged by the vacuum nozzle of the surface mounting equipment for positive engagement of the contact by the vacuum nozzle; and connecting means for connecting surface mount contacts in a continuous strip of series-connected surface mount contacts, said connecting means being formed between said second conductive portions and severable to permit selective detachment of one surface mount contact from said continuous strip by the surface mounting equipment for surface mounting on the conductive pads by engagement of said pick-up surface by the vacuum nozzle.

2. Surface mount contact as defined in claim 1, wherein said contact comprises a surface mount jumper, said first conductive portion comprising spaced leg portions dimensioned to correspond to the dimensions of two spaced conductive pads on which the jumper is to be mounted, and said second conductive portion comprising a conductive linking portion generally offset from the plane of said leg portions and arranged in a plane generally parallel to the plane of said leg portions and extending between said leg portions, said conductive linking portions providing said generally flat pick-up surface.

3. Surface mount jumpers for mounting on conductive pads on a printed circuit board by surface mounting equipment which includes a vacuum nozzle, comprising a plurality of like surface mount jumpers each provided with spaced leg portions dimensioned to correspond to the dimensions of the conductive pads on which the jumpers are to be mounted, said leg portions being arranged generally in a common plane; a generally flat conductive linking portion generally offset from said leg portions in a plane generally parallel to said common plane to form a pick-up surface and extending between said leg portions; and connecting means for connecting said surface mount jumpers in a continuous strip of series-connected surface mount jumpers, said connecting means being formed between said conductive linking portions and being severable to permit selective detachment of one surface mount jumper from said continuous strip by the surface mounting equipment for surface mounting on the conductive pads by engagement of said pick-up surface by the vacuum nozzle.

4. Surface mount jumpers as defined in claim 3, wherein two leg portions are provided for each jumper and said linking portion comprises a flat elongate conductor extending between said two leg portions.

5. Surface mount jumpers as defined in claim 4, wherein said elongate conductors are arranged to be parallel to each other when connected to form said strip, and said connecting means comprises tab means extending between adjacent elongate conductors to secure the same to each other.

6. Surface mount jumpers as defined in claim 5, wherein said tab means comprises two spaced tabs extending between adjacent elongate conductors.

7. Surface mount jumpers as defined in claim 6, wherein said spaced tabs are arranged in regions proximate to said leg portions.

8. Surface mount jumpers as defined in claim 7, wherein said continuous strip is wound in a coil on a reel for automated feeding to surface mount equipment.

9. A roll of surface mount jumpers for mounting on conductive pads on a printed circuit board by surface mounting equipment which includes a vacuum nozzle, comprising a continuous strip of surface mount jumpers rolled in a coil and mounted on a reel for use by a feeder used in conjunction with surface mount equipment, said continuous strip comprising a plurality of like surface mount jumpers each provided with spaced leg portions dimensioned to correspond to the dimensions of the conductive pads on which the jumpers are to be mounted, said leg portions being arranged generally in a common plane; a generally flat conductive linking portion generally offset from said leg portions in a plane generally parallel to said common plane to form a pick-up surface and extending between said leg portions; and connecting means for connecting said surface mount jumpers in a continuous strip of series-connected surface mount jumpers, said connecting means being formed between said linking portions and being severable to permit selective detachment of one surface mount jumper from said continuous strip by the surface mounting equipment for surface mounting on the conductive pads by engagement of said pick-up surface by the vacuum nozzle.

* * * * *